US006547003B1

(12) United States Patent
Bangash et al.

(10) Patent No.: US 6,547,003 B1
(45) Date of Patent: Apr. 15, 2003

(54) DOWNHOLE ROTARY WATER SEPARATION SYSTEM

(75) Inventors: Yasser Khan Bangash, Norman, OK (US); Michael R. Berry, Norman, OK (US); Stephen E. Conner, Edmond, OK (US)

(73) Assignee: Wood Group ESP, Inc., Oklahoma City, OK (US)

( * ) Notice: Subject to any disclaimer, the term of this patent is extended or adjusted under 35 U.S.C. 154(b) by 0 days.

(21) Appl. No.: 09/675,364

(22) Filed: Sep. 29, 2000

Related U.S. Application Data

(60) Provisional application No. 60/211,868, filed on Jun. 14, 2000.

(51) Int. Cl.[7] ..... E21B 43/40
(52) U.S. Cl. ..... 166/106; 166/66.4; 166/68
(58) Field of Search ..... 166/266, 265, 166/263, 66.4, 106, 179, 369, 68, 105

(56) References Cited

U.S. PATENT DOCUMENTS

| | | | | |
|---|---|---|---|---|
| 4,296,810 A | | 10/1981 | Price | |
| 4,688,650 A | | 8/1987 | Hayatdavoudi et al. | |
| 4,738,779 A | | 4/1988 | Carroll et al. | |
| 4,805,697 A | | 2/1989 | Fouillout et al. | |
| 4,844,817 A | | 7/1989 | Flanigan et al. | |
| 5,110,471 A | | 5/1992 | Kalnins | |
| 5,154,826 A | | 10/1992 | Prendergast et al. | |
| 5,296,153 A | | 3/1994 | Peachey | |
| 5,302,294 A | | 4/1994 | Schubert et al. | |
| 5,335,732 A | | 8/1994 | McIntyre | |
| 5,456,837 A | | 10/1995 | Peachy | |
| 5,482,117 A | | 1/1996 | Kolpak et al. | |
| 5,693,225 A | | 12/1997 | Lee | |
| 5,711,374 A | | 1/1998 | Kjos | |
| 5,730,871 A | | 3/1998 | Kennedy et al. | |
| 6,017,456 A | | 1/2000 | Kennedy et al. | |
| 6,033,567 A | * | 3/2000 | Lee et al. | 210/512.2 |
| 6,056,054 A | * | 5/2000 | Brady et al. | 166/265 |
| 6,068,053 A | | 5/2000 | Shaw | |
| 6,092,599 A | * | 7/2000 | Berry et al. | 166/265 |
| 6,131,655 A | | 10/2000 | Shaw | |

* cited by examiner

*Primary Examiner*—Thomas B. Will
*Assistant Examiner*—Zakiya Walker
(74) *Attorney, Agent, or Firm*—Crowe & Dunlevy, P.C.

(57) ABSTRACT

A downhole rotary water separation system for the separation and transfer of different density fluids in downhole applications using a pump, a motor, a rotary separator and a shaft-incorporated packer, as necessary, with a minimum of conduits and tubes. Torque can be transferred between all moving components as well as the packer such that the motor and pump can be disposed above or below the separator.

21 Claims, 8 Drawing Sheets

DOWNHOLE ROTARY WATER SEPARATION SYSTEM

RELATED APPLICATIONS

This application claims the benefit of Provisional Application No. 60/211,868 entitled "Downhole Rotary Oil Water Separator" filed Jun. 14, 2000.

FIELD OF INVENTION

The present invention relates generally to the field of downhole water separation, and more particularly, but not by way of limitation, to downhole water separation used in conjunction with submersible pumps.

BACKGROUND OF INVENTION

Fluid separation systems are an important and expensive part of most hydrocarbon production facilities. The separation of fluids based on different properties is known in the industry. A variety of separation methods are used, including gravity separators, membrane separators and cyclone separators. Each of these separators uses a different technique to separate the fluids and each achieves a different efficiency depending upon the device and its application. Gravity separators, for instance, can be efficient when there is a great density difference between the two fluids and there are no space or time limitations. Another separator, the membrane separator, uses the relative diffusibility of fluids for separation. The membrane separator is not well suited to use with an electric submersible pump (ESP) due to the high flow rates and limited space.

Since electric submersible pumps are capable of producing fluids at high rates and pressures, such pumps are often used for downhole fluid movement including downhole fluid separation applications. Any separation method that is time dependant, such as the above mentioned gravity and membrane separators, do not work well with an electric submersible pump. Another separator, the hydrocyclone, on the other hand, has been used effectively with electric submersible pumps, both on the surface and below the surface. Hydrocyclone separators are non-rotating devices, using a specific geometric shape to induce fluid rotation. They create high g-forces in the fluids as the fluids spin though the device. This process results in the lighter fluids forming a core in the middle of the separator. This core is extracted out the topside of the hydrocyclone separator as the oil stream. The separated water is rejected from the opposite side. One problem associated with this method of separation is the excessive pressure drop in the fluid passing through the hydrocyclone.

This current method of separating fluids downhole has certain problems associated with it. First, a system design which incorporates an ESP with a hydrocyclone, is often complicated. Depending upon the relative location of the disposal and the production zones, these systems usually have one or two conduits running from the separator and pump to the respective zones or are limited on where they can be placed. These conduits not only cause excessive pressure drops but also are the weak links in the assembly, often causing mechanical problems during installation.

Secondly, a hydrocyclone separator is a non-rotating device. Since the separator can not rotate, special provisions have to be made in a separation system design for torque transmission above or below the separator. These provisions, which depend on the particular application and the location of the injection and production zones, further complicate the design of the separation system. Finally a hydrocyclone does not work well with free gas in the process stream. Free gas hinders the separation process in the hydrocyclone as is well known to those skilled in the art. This is also a problem when volatile oils are present as there is a pressure drop in the process stream as the volatile oil passes through the hydrocyclone, thereby forming free gas to be liberated and making separation difficult.

The present invention, overcoming these problems, provides a separation system using a rotary device in conjunction with standard ESP equipment.

SUMMARY OF INVENTION

The present invention includes a downhole rotary water separation system for the separation and transfer of different density fluids in downhole applications using a pump, motor, rotary separator and a shaft-incorporated packer, as necessary, with a minimum use of conduits. Since torque can be transferred between all moving components as well as the packer, system arrangement is not restricted to one in which the motor and pump must be directly above or below the separator.

The objects, advantages and features of the present invention will become clear from the following detailed description and drawings when read in conjunction with the claims.

BRIEF DESCRIPTION OF DRAWINGS

FIG. 8 is a partial exploded view of the rotary separator of FIG. 4 with a modified vane design.

FIG. 9 is a partial cutaway view of the shaft-incorporated packer of FIG. 1.

DETAILED DESCRIPTION

Figure 1:
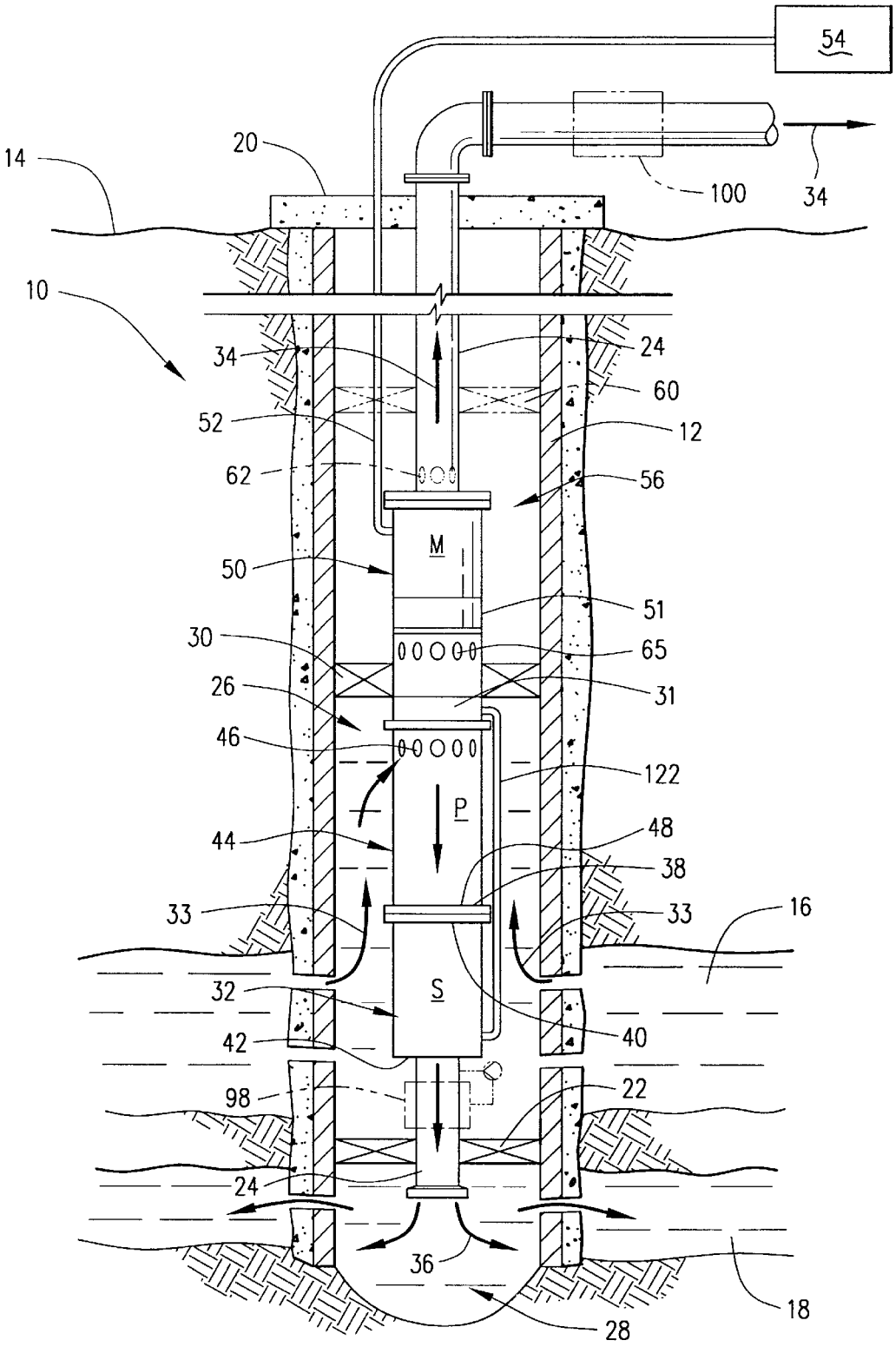
FIG. 1 is an elevational, partially detailed view of a downhole rotary water separation system constructed in accordance with the present invention.

Shown in FIG. 1 is a downhole rotary water separation system 10 in a wellbore 12 located below the surface 14 of the earth and extending through a hydrocarbon producing zone 16 and a water injection zone 18. It will be understood by those skilled in the art that the hydrocarbon producing zone 16 will actually produce a hydrocarbon and water mixture with the percentage of water varying from the acceptable level to a level where the water must be separated from the hydrocarbon. It is to the latter situation that the present invention is directed. On the surface of the wellbore 12 is a wellhead 20.

A conventional first packer 22 is set on tubing 24 and disposed in the wellbore 12, separating a first flow channel 26 from the hydrocarbon producing zone 16 and a second water injection channel 28 which is in communication with the water injection zone 18 in the same wellbore 12. Above the first packer 22 is disposed a second packer 30 and an adapter 31, if necessary. The downhole rotary water separation system 10 includes a separator 32 capable of separating a produced hydrocarbon and water fluid mixture 33 into a hydrocarbon-rich stream 34 and a water-rich stream 36.

The separator 32 has an inlet 38 in communication with a pump 44, a first outlet 40 for the hydrocarbon-rich stream 34 and a second outlet 42 for the water-rich stream 36. The separator 32 is in fluid communication with the injection pump 44 via a shaft (not shown) for pressurizing the water-rich stream 36 for injection. The injection pump 44 has a pump inlet 46 and a pump outlet 48 and is powered by an electrical submersible motor 50 with a shaft (not shown) that is coupled to the injection pump 44 through a seal section 51. The motor 50 is also used to rotate the separator 32 when necessary. FIG. 1 shows a power cable 52 connecting the electrical submersible motor 50 to a power supply 54 located on the surface 14. The pump 44 and the separator 32 are capable of transferring torque when the separator is a rotary separator 32.

The downhole rotary water separation system 10 described above uses the minimum number of conduits or tubes to transport liquids through the use of a rotating separator and the use of both conventional and shaft-incorporated packers, such as the Multi set Integral Packer (MIP) described in a co-pending patent application entitled "METHODS AND APPARATUS FOR PRODUCING FLUID FROM A WELL WITH A SUBMERSIBLE PUMP" Ser. No. 09/550,364 filed Apr. 20, 2000 and assigned to the assignee of the present invention (now abandoned).

FIG. 1 shows the use of the shaft-incorporated packer as the second packer 30 in the downhole rotary water separation system 10. This allows the transfer of torque from the electrical submersible motor 50 to the separator 32 through the shaft-incorporated packer 30. The shaft-incorporated packer 30 also packs off the casing 12 at this location, providing the required isolation between the first flow channel 26 and a surface channel 56. The heavier water-rich stream 36 is ejected out of the separator's second outlet 42 and is injected back into the water injection zone 18.

In FIG. 1, the lower zone is the water injection zone 18 while the upper zone is the hydrocarbon producing zone 16. The conventional packer 22 is placed between the zones to isolate each zone. The fluid mixture 33 is pressurized by the pump 44 which is attached to, and powered by, the electric submersible motor 50 which in turn is attached to the pump 44 with the help of the shaft-incorporated packer (MIP) 30 (described above). The fluid mixture 33, after being pressurized by the pump 44, enters the separator 32. Although the present system can be used with any downhole separator 32, the use of the rotary separator is preferred when torque transfer is important. This is critical in certain circumstances described below. In those situations, if a non-rotating separator is used, the system will not work.

The fluid mixture 33 is separated on the basis of densities. The heavier fluid is in the water-rich stream 36 sent to the injection zone 18 and the lighter fluid is in the hydrocarbon-rich stream 34 transferred to the surface 12 through tubes. These tubes transfer the hydrocarbon-rich stream 34 to the bottom part of the MIP 30. This hydrocarbon-rich stream 34 passes through the MIP 30 past the motor 50 to provide the requisite cooling for the motor 50. This hydrocarbon-rich stream 34 can be produced through the annulus 48 or the tubing 24. A third packer 60 and perforations 62 in the tubing 24 allow the hydrocarbon-rich stream 34 to communicate with the tubing 24. In some cases where the situation demands, a shroud may be used to reduce the casing area and increase the flow around the motor 50.

Figure 2:
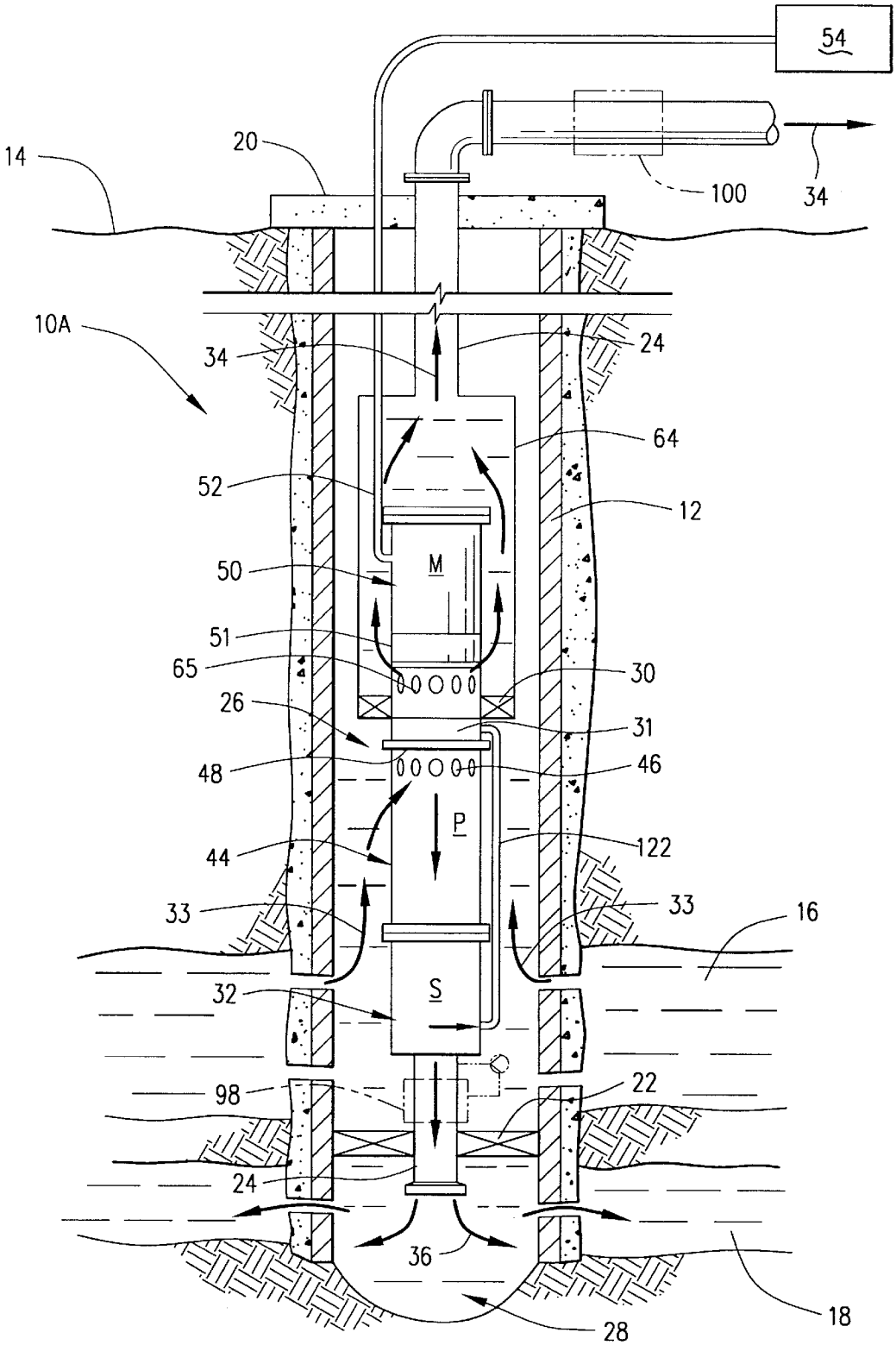
FIG. 2 is an elevational, partially detailed view of the system of FIG. 1 as modified by the addition of a shrouded motor.

The downhole rotary water separation system 10A shown in FIG. 2 is similar to the system shown in FIG. 1 but the motor 50 is inside an enclosed shroud 64 to help achieve the required cooling by keeping the velocity of fluid around the motor 50 at least 1 ft/sec. The downhole rotary water separation system 10A has a specially designed feed through assembly used to transfer the power cable into the shroud 64. Standard tubing 24 is attached to the shroud 64 to produce the hydrocarbon-rich stream 34.

Figure 3:
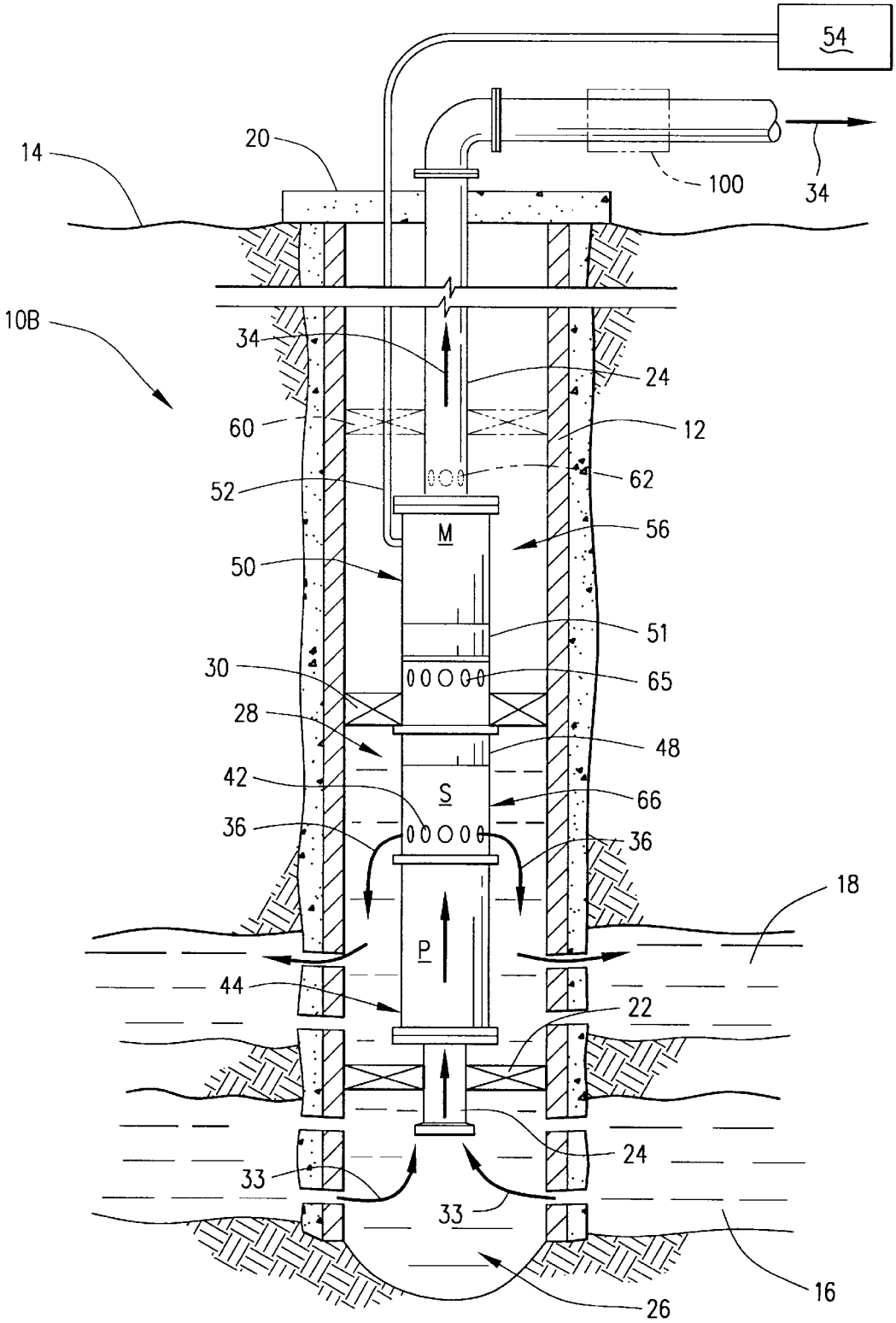
FIG. 3 is an elevational, partially detailed view of the system of FIG. 1 modified by placing the rotary separator between the motor and the pump.

FIG. 3 shows a downhole rotary water separation system 10B, similar to that described above, but with the location of the production 16 and injection 18 zones switched. In this case, production zone 16 is below the injection zone 18, thus requiring a configuration where the rotary separator of the present design is necessary to a successful separation system design. The produced fluid mixture 33 is pressurized in the pump 44 and enters a separator 66 that is attached to the top of the pump 44. The produced fluid mixture 33 in the separator 66 is separated based on the density differences into two streams. The water rich stream 36 is ejected out of the separator at the second outlet 42 which in this case consists of exhaust holes. This water rich stream 36 enters the injection zone 18.

The hydrocarbon rich stream 34 enters the specially designed adapter 31. This adapter 31 serves as the connection between the separator housing and the MIP packer 30. The hydrocarbon rich stream 34 leaves the exhaust ports 65 of the MIP packer 30 and enters the surface channel or annulus 56. This hydrocarbon rich stream 34 flows past the motor 50 to provide the necessary cooling. The hydrocarbon rich stream 34 then enters the tubing string 24 and is communicated to the top of the well bore 12. Depending upon the particular application, the fluid can also be produced through the surface channel 56. By the use of the rotary separator 66 and the MIP packer 30, the need of any tubes or conduits in this application is eliminated.

Figure 4:
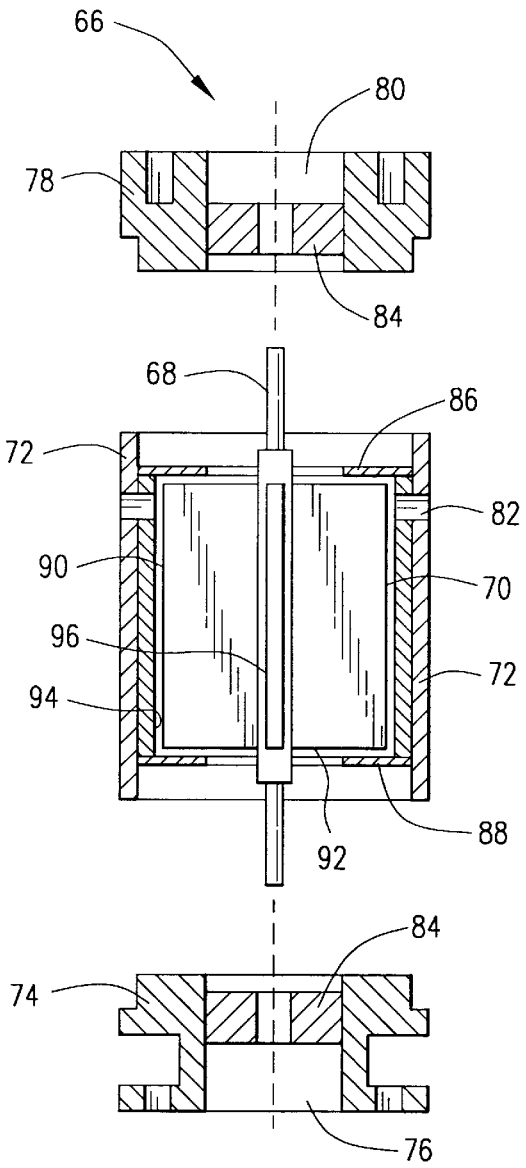
FIG. 4 is a partial exploded view of the rotary separator in FIG. 3.

The rotary separator 66 shown in FIG. 4 can be attached upstream from the pump 44 or downstream of the pump 44. The rotary separator 66 performs the separation process discussed above, separating the produced fluid mixture 33 based on density, and serves additional function transferring torque to and from the pump 44 or motor 50.

The rotary separator 66 has a rotating separator shaft 68 and two or more vanes 70 configured to rotate with the separator shaft 68. The vanes 70 are preferably perpendicular to the separator shaft 68, but can be mounted at any angle relative to the separator shaft 68. The vanes 70, shown as rectangular in shape, can be any suitable shape, height or thickness and can be mounted as a hub fixed to the separator shaft 68 or integral to the separator shaft 68. The vanes 70, or a second set of vanes, can be shaped to provide a net positive head through the rotary separator 66.

The rotary separator 66 has a housing 72 in which the separator shaft 68 and vanes 70 rotate. The housing 72 has a first end 74 with an inlet 76, and a second end 78 with a hydrocarbon discharge outlet 80. A water discharge port 82 is located in the housing near the hydrocarbon discharge outlet 80 end of the housing 72.

The separator shaft 68 is supported within the housing 72 by one or more bearings 84. The bearings 84 can be constructed to allow fluid to pass, or the housing 72 can be constructed to allow fluids to bypass the bearings 84. The water discharge port 82 is sized to accommodate the desired water flow rate passage therethrough, and plural water discharge port 82 can be provided. The rotary separator 66 can also incorporate an optional obstruction such as an upper orifice plate 86 and a lower orifice plate 88 with a reduced inner diameter, such as in an end cap placed between the hydrocarbon discharge outlet 80 and the first end 74.

The obstruction blocks the flow of fluid along an inner wall 94 of the housing 72 but does not block flow along a shaft wall 96. This restriction is sized to allow the maximum desired hydrocarbon production stream 34 to flow through the housing 72. The water discharge port 82 can be sized cooperatively with the fixed restrictive orifice plate 86. A preferred method is to have an adjustable downhole choke 98 positioned to regulate the hydrocarbon-rich stream 34 as shown in FIG. 2. Other control valves can be used to regulate the other flow streams such as a water disposal control valve 100, as shown in FIG. 2 placed to control the water-rich stream 36.

Figure 5:
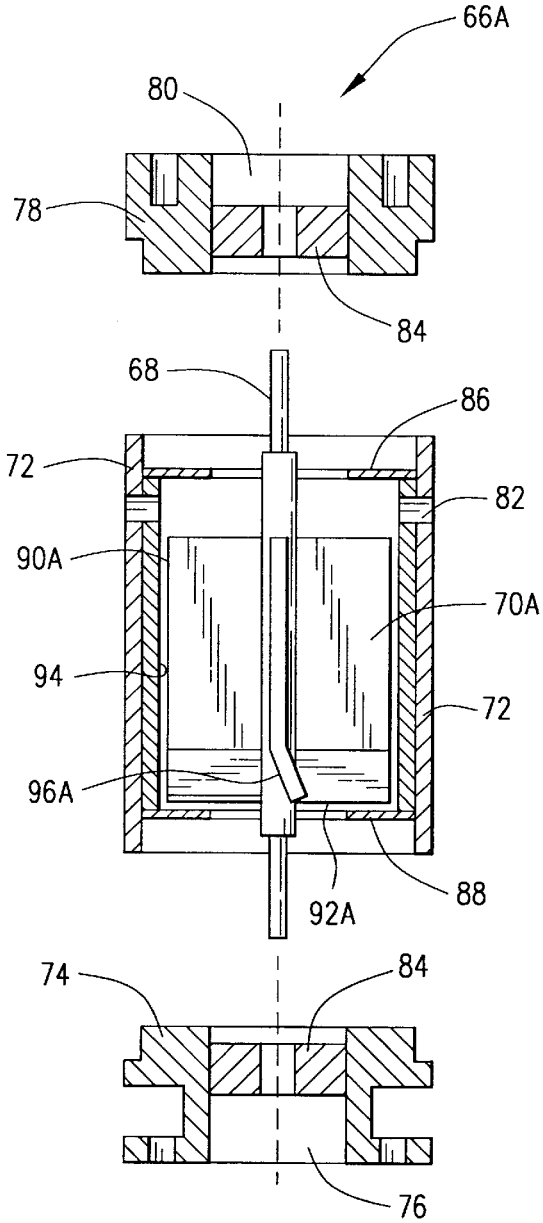
FIG. 5 is a partial exploded view of the downhole rotary separator of FIG. 4, modified by placing the water discharge port above the last vane.
Figure 6:
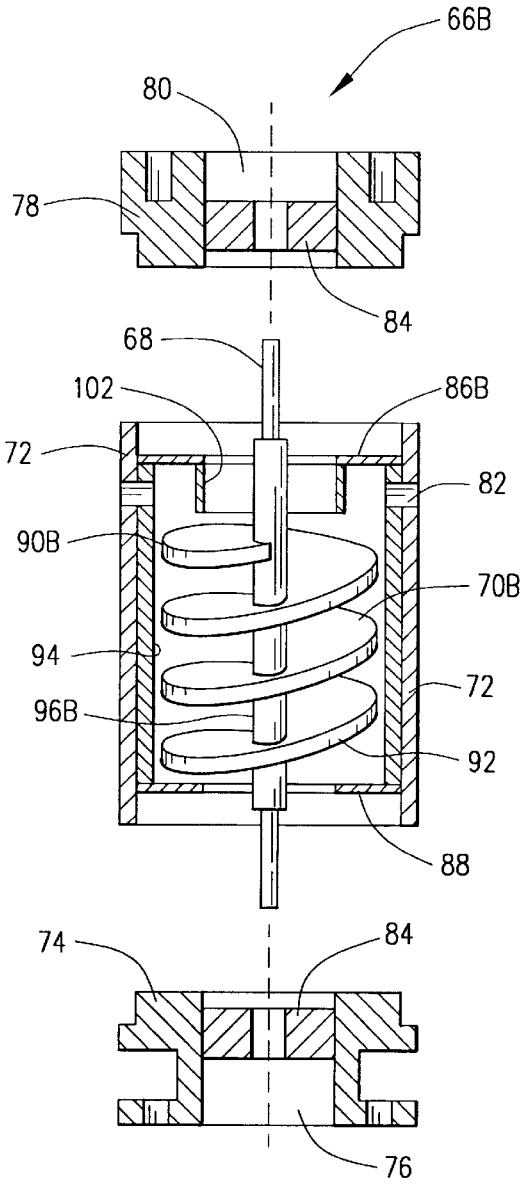
FIG. 6 is a partial exploded view of the downhole rotary separator of FIG. 4, modified by placing an obstruction device attached to the plate.
Figure 7:
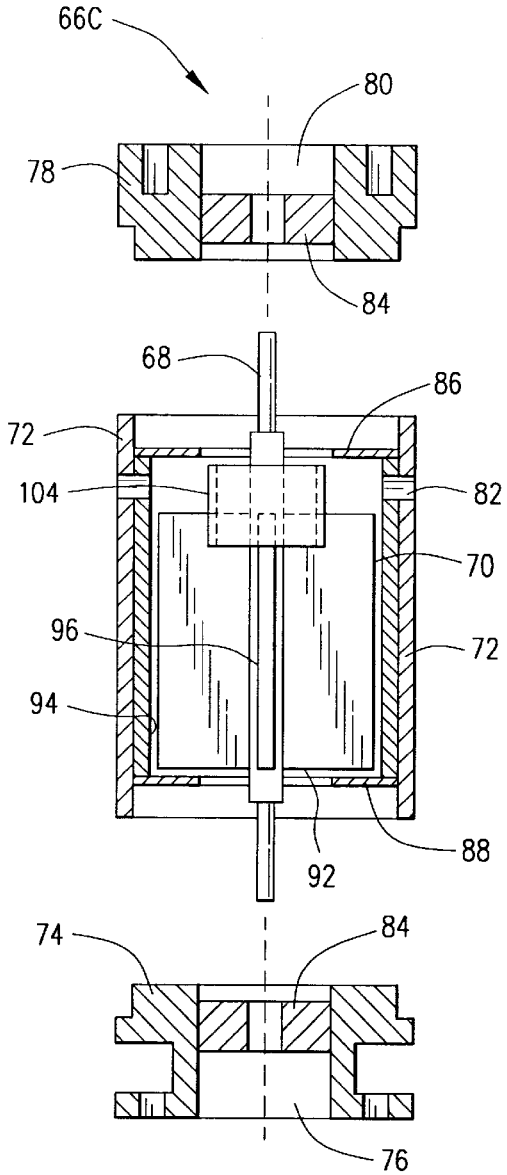
FIG. 7 is a partial exploded view of the downhole rotary separator of FIG. 4 modified by placing the obstruction device attached to the vanes.
Figure 5:
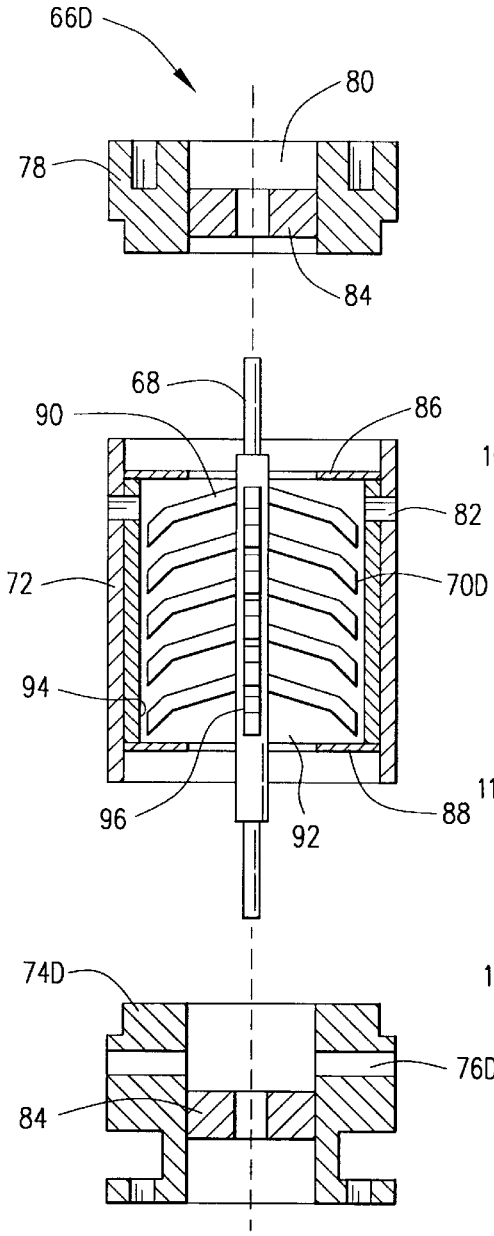
Figure 5:
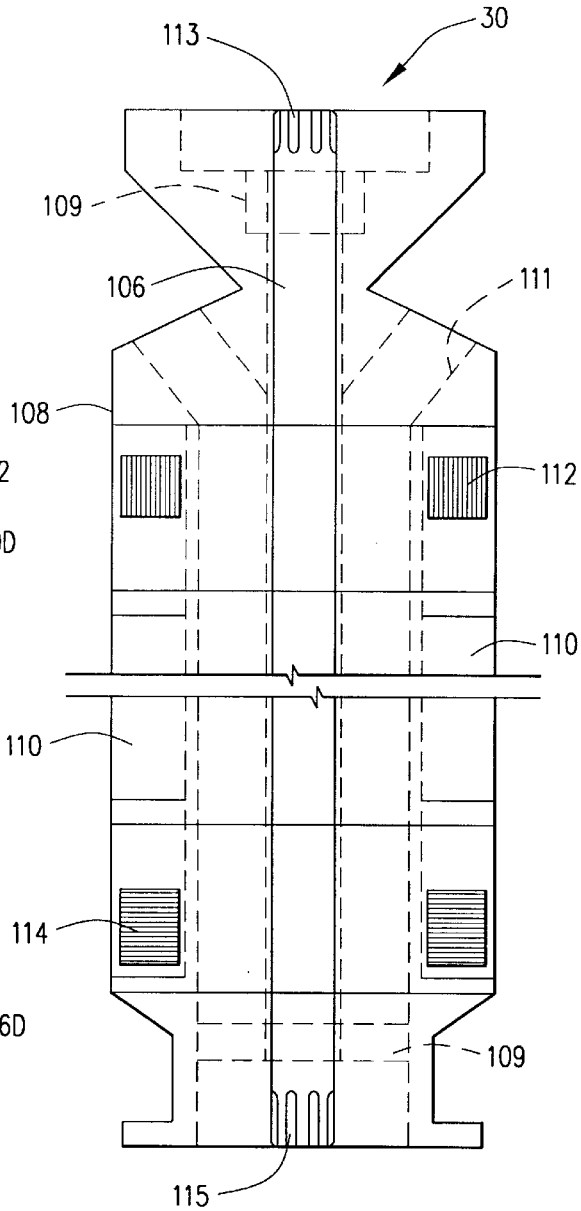

FIG. 5 shows a rotary separator 66A similar in construction to the rotary separator 66 of FIG. 4, in which the water-rich stream discharge port 82 is located downstream of the last vane 90A. In FIG. 5, the vanes 70A are not a simple rectangular shape but the vane shape is still independent of the input and output locations. A portion of each vane is set at an angle to the rest of the vane 70A. FIG. 6 shows a rotary separator 66B where the orifice plate 86B has a sleeve 102 extending toward the vanes 70B which have a helical shape. FIG. 7 shows a rotary separator 66C and sleeve 104 attached to the vanes 70 as opposed to the sleeve 102 attached to the orifice plate 86B in FIG. 6.

A rotary separator 66D of FIG. 8 has an inlet port 76D integral to a first end 74D. The intake port 76D extends perpendicular to the axis of the rotary separator 66D, but may take any suitable shape or angle. The vanes 70D are also shown in an essentially horizontal rectangular shape instead of the essentially vertical rectangular shape of the vanes 70 of FIG. 4.

FIG. 9 shows the shaft-incorporated packer 30 of the type that can be used to transfer torque between the motor 50 and the pump 44 or between the motor 50 and the rotary separator 66. The shaft-incorporated packer 30 has a packer shaft 106 supported in a packer housing 108 with shaft support bushings 109. The shaft-incorporated packer 30 may have a packing element 110 and both radial hold slips 112 near a first end 113, and vertical hold slips 114 near a second end 115. This shaft-incorporated packer 30 is similar to the MIP packer described in co-pending, patent application Ser. No. 09/550,364 by the same assignee (now abandoned).

Figure 10:
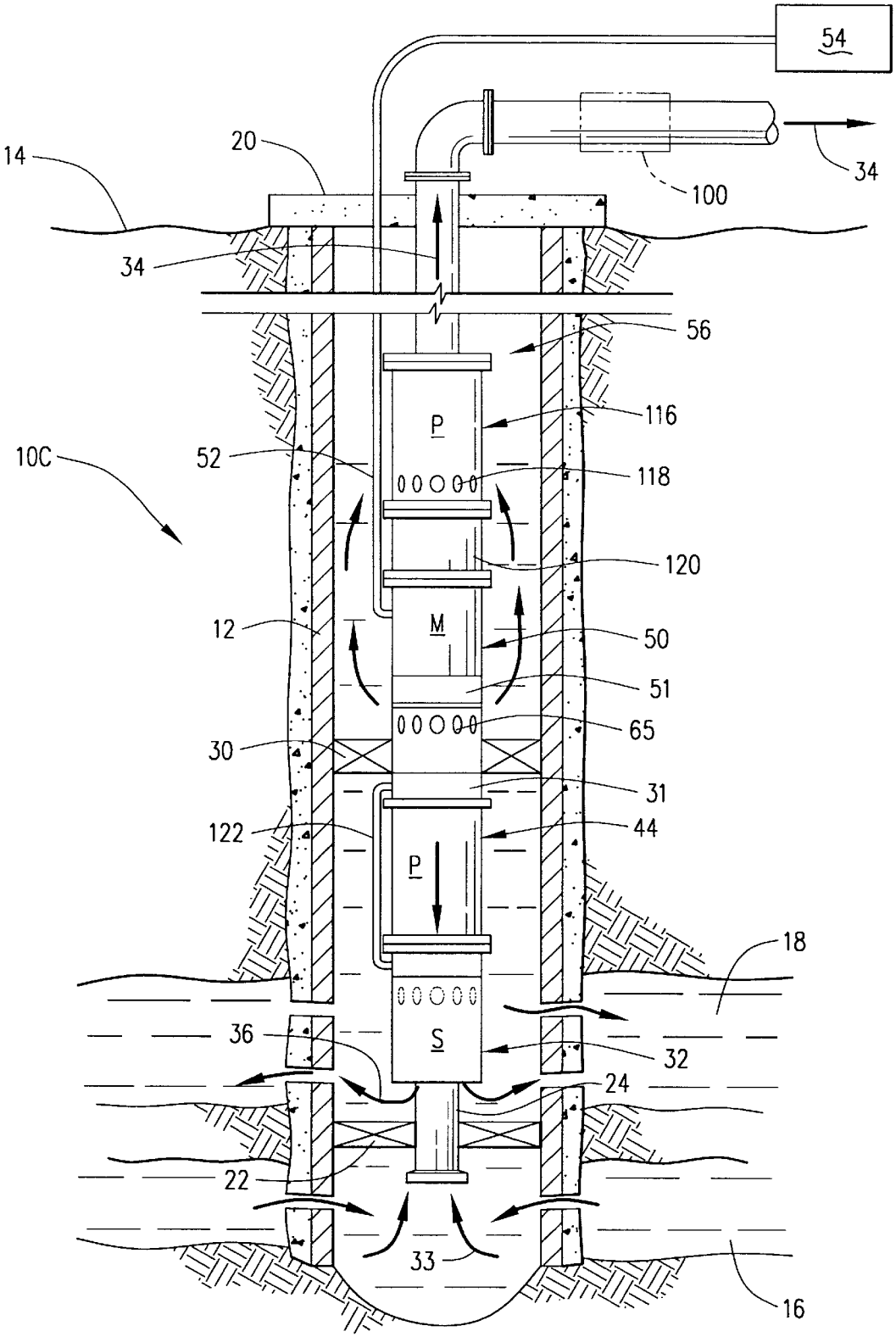
FIG. 10 is an elevational, partially detailed view of the system of FIG. 1 modified to include a second pump.

The downhole rotary water separation system 10C shown in FIG. 10 is a pull-through system that can incorporate a second production pump 116 with a pump inlet 118, when necessary. The second production pump 116 is separated from the motor 50 by seals 120. The second production pump 116 is especially helpful in situations when the hydrocarbon-rich stream 34 does not have sufficient energy imparted by the injection pump 44 to flow to the surface 14 unaided. FIG. 10 also shows the use of a tube 122 to bypass the pump 44. In this embodiment, the motor 50 operates both pumps 44, 116 and the separator 32. The separator 32 in this embodiment does not have to be a rotary separator 66.

Figure 11:
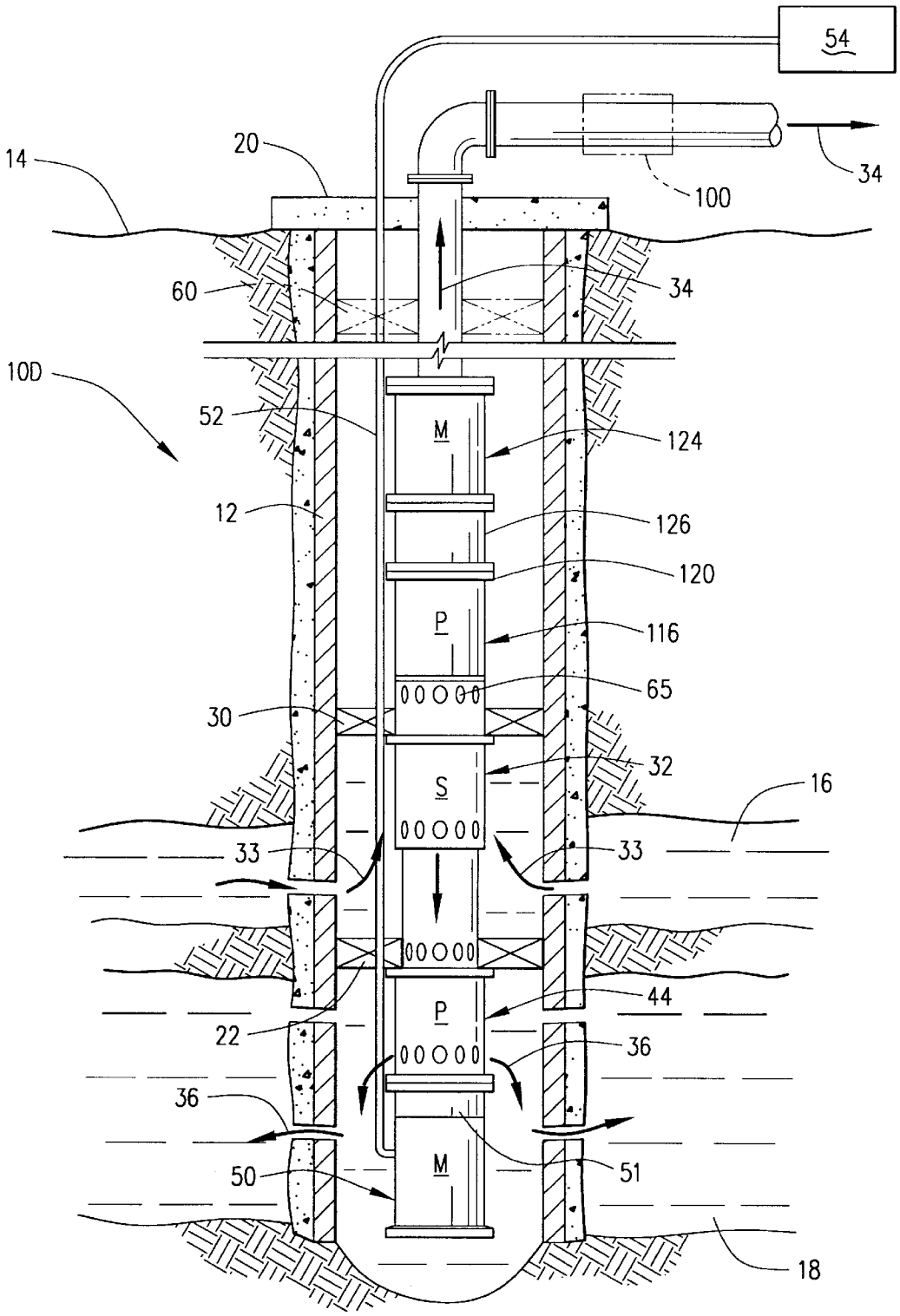
FIG. 11 is an elevational, partially detailed view of the system of FIG. 1 modified to include a second pump and a second motor.

The downhole rotary water separation system 10D shown in FIG. 11 is another embodiment similar to the pull-through downhole rotary water separation system 10C of FIG. 10 and that incorporates the second production pump 116, as described above, as well as a second motor 124 separated from the second production pump by seals 126. The hydrocarbon-rich stream 34 can flow past the motor 50 in all the manners described above. It will be clear to those skilled in the art, that the two packers 22, 30 should be shaft-incorporated packers but that packer 60 can be a conventional packer. It will be also clear to one skilled in the art that the lower motor 50 may need to be an ESM with a power supply cable 52 but that the upper, second motor 124, which would be located at a shallower depth, could be a variety of pumps, such as a beam pump.

As will be clear to one skilled in the art, the downhole rotary water separation systems 10–10D can be incorporated as part of a larger system to perform other essential downhole functions. For instance, a gas separator can be attached to the downhole rotary water separation system system 10–10D to handle excess gas before the gas passes through the downhole rotary water separation system 10–10D. The zones may also be separated by other downhole means, such as a liner hanger instead of a stand alone packer. The downhole rotary water separation systems 10–10D are designed to work with the other tools that one skilled in the art uses to produce hydrocarbons and inject fluids in a downhole environment.

The use of a separator, including the presently disclosed rotary separator 66 coupled with a pump, motor, and a shaft-incorporated packer 30, described above, can be used for downhole oil water separation in any combination of situations. The downhole rotary water separation system 10 separates fluid when the rotary separator 32 is in close proximity to the underlying disposal zone 18, as in FIG. 1, or when the zones are a great distance from the rotary separator 32 or each other, as in FIG. 11. As shown in FIG. 1, fluid travels up the wellbore 12 to the pump intake 46. The pump 44 pressurizes the production fluid mixture 33 and the rotary separator 32 attached to the pump 44, performing dual purposes.

First, the rotary separator 32 separates the fluid mixture 33 on the basis of density as described above. Secondly, the rotary separator 32 provides the means of transferring torque to the pump 44.

The downhole rotary water separation system 10B of FIG. 3 is shown in a situation where the rotary separator 66 and the shaft-incorporated packer 30 are required because there is a need for transfer of torque by the rotary separator 66 and packer 30 which are located between the motor 50 and the pump 44.

The rotary separator 66 can be regulated by monitoring either the water content of the hydrocarbon-rich stream 34 or the oil content of the water-rich stream 36. Regulation of the relative flow rates can be achieved by adjusting the water-rich stream choke 98, the hydrocarbon-rich stream choke 100 and the operating speed of the separator.

While presently preferred embodiments have been described for purposes of this disclosure, numerous changes may be made, some indicated above, which will readily suggest themselves to one skilled in the art and which are encompassed in the spirit of the invention disclosed and as defined in the appended claims.

We claim:

1. A downhole rotary water separation system for use in a wellbore extending through a hydrocarbon producing zone defining a first flow channel and a water injection zone defining a second flow channel in the same wellbore, the system comprising:

a tubing conduit disposed in the wellbore and in fluid communication with the hydrocarbon producing zone and the water injection zone, the tubing located between the first flow channel and the second flow channel;

a packer disposed in the wellbore and connected to the wellbore and the tubing such that the packer separates the first flow channel from the second flow channel;

a rotary separator separating a produced hydrocarbon and water mixture from the hydrocarbon producing zone into a hydrocarbon-rich stream and a water-rich stream, the rotary separator having an inlet coupled to the first flow channel and an outlet coupled to the second flow channel, the rotary separator comprising:

a housing containing a separator shaft supported in the housing by a bearing that allows fluid to pass, the housing having a lower end with an inlet, and an upper end with a hydrocarbon discharge outlet;

a plurality of vanes attached to the separator shaft and configured to rotate with the separator shaft in the housing, the vanes mounted at an angle relative to the separator shaft;

a water discharge port located in the housing near the hydrocarbon discharge outlet end of the housing and sized to allow desired water flow to pass therethrough;

an injection pump connected to the housing of the rotary separator in fluid communication with the rotary separator for pressurizing the water-rich stream for injection; and an electric submersible motor connected to the injection pump and to the rotary separator.

2. The system of claim 1 wherein a second packer is disposed in the wellbore above the first packer such that the separator is in communication with a surface channel above the second flow channel.

3. The system of claim 2 wherein the separator is in communication with the surface channel via a tubular member.

4. The system of claim 3 wherein the second packer has a packer shaft disposed in a central channel in the second packer such that the packer shaft has a first and second end.

5. The system of claim 4 wherein:

the separator is adapted to be positioned within the wellbore adjacent the hydrocarbon producing zone and below the second packer;

the motor is disposed above the second packer and has a shaft connected to the second packer at the first end; and the pump is disposed below the second packer and has a shaft connected to the second packer at the second end.

6. The system of claim 5 further comprising a production pump disposed in the wellbore in the surface channel and in fluid communication with the separator for pressurizing the hydrocarbon-rich stream.

7. The system of claim 4 further comprising a production pump disposed in the wellbore in the surface channel and in fluid communication with the separator for pressurizing the hydrocarbon-rich stream.

8. The system of claim 4 wherein:

the separator is adapted to be positioned within the wellbore adjacent the water injection zone and below the second packer;

the motor has a motor shaft and is disposed above the second packer, the motor shaft connected to the packer shaft; and the injection pump has a pump shaft and is disposed below the second packer, the pump shaft connected to the packer shaft and to the separator shaft.

9. The system of claim 8 further comprising a production pump disposed in the wellbore in the surface channel and in fluid communication with the separator for pressurizing the hydrocarbon-rich stream.

10. The system of claim 1 wherein the rotary separator has an obstruction device placed between the vanes and the hydrocarbon discharge outlet such that the obstruction device blocks the flow of fluid along the inner wall of the housing but does not block flow along the shaft wall.

11. The system of claim 10 wherein the obstruction device is an orifice plate placed between the vanes and the hydrocarbon discharge outlet such that the obstruction device blocks the flow of fluid along the inner wall of the housing but does not block flow along the shaft wall and wherein the obstruction device is sized to allow a maximum desired oil hydrocarbon flow rate through the obstruction device.

12. The system of claim 10 wherein the obstruction device is an end cap having an orifice plate and an attached open cylinder placed between the vanes and the hydrocarbon discharge outlet such the obstruction device blocks the flow of fluid along the inner wall of the housing but does not block flow along the shaft wall and wherein the obstruction device is sized to allow the maximum desired oil hydrocarbon flow rate through the obstruction device.

13. The system of claim 10 wherein the orifice plate of the obstruction device is attached to the vanes.

14. The system of claim 10 wherein the water discharge port is located downstream of the vanes.

15. The system of claim 10 wherein the water discharge port is located beneath the vanes.

16. The system of claim 10 wherein the vanes are perpendicular to the axis of the device, but may take any suitable shape or angle.

17. The system of claim 10 wherein the second packer has a packer shaft and wherein:

the rotary separator is adapted to be positioned within the wellbore adjacent the hydrocarbon producing zone and below the second packer;

the motor is disposed above the second packer wherein a motor shaft is connected with the packer shaft; and the pump is disposed below the second packer wherein a pump shaft is connected to the separator shaft and the packer shaft.

18. The system of claim 17 further comprising a production pump disposed in the wellbore in the surface channel and in fluid communication with the separator for pressurizing the hydrocarbon-rich stream.

19. The system of claim 10 further comprising a production pump disposed in the wellbore in the surface channel and in fluid communication with the separator for pressurizing the hydrocarbon-rich stream.

20. The system of claim 10 wherein the second packer has a packer shaft and wherein:

the rotary separator is adapted to be positioned within the wellbore adjacent the water injection zone and below the second packer;

the motor is disposed above the second packer wherein a motor shaft is connected to the packer shaft; and the pump is disposed below the second packer wherein a pump shaft is connected to the separator shaft and the packer shaft.

21. The system of claim 20 further comprising a production pump disposed in the wellbore in the surface channel and in fluid communication with the separator for pressurizing the hydrocarbon-rich stream.

* * * * *